United States Patent [19]

Theurer et al.

[11] 4,391,134

[45] Jul. 5, 1983

[54] MEASURING APPARATUS FOR RAIL HEAD RUNNING SURFACE IRREGULARITIES

[75] Inventors: Josef Theurer, Vienna; Johann Hansmann, Klosterneuburg; Klaus Riessberger, Vienna, all of Austria

[73] Assignee: Franz Plasser Bahnbaumaschinen-Industriegesellschaft m.b.H., Vienna, Austria

[21] Appl. No.: 241,832

[22] Filed: Mar. 9, 1981

[30] Foreign Application Priority Data

Feb. 27, 1980 [AT] Austria ..... 1093/80

[51] Int. Cl.[3] ..... B61K 9/00

[52] U.S. Cl. ..... 73/146; 33/144

[58] Field of Search ..... 73/146; 33/1 Q, 144; 51/5 D, 178

[56] References Cited

U.S. PATENT DOCUMENTS

| | | | |
|---|---|---|---|
| 3,808,693 | 5/1974 | Plasser et al. | 33/144 |
| 3,828,440 | 8/1974 | Plasser et al. | 33/1 Q |
| 3,882,607 | 5/1975 | Plasser et al. | 33/1 Q |
| 4,075,888 | 2/1978 | Buhler | 33/144 |
| 4,135,332 | 1/1979 | Theurer | 51/5 D |
| 4,288,855 | 9/1981 | Panetti | 33/1 Q |

FOREIGN PATENT DOCUMENTS

| | | | |
|---|---|---|---|
| 825427 | 12/1951 | Fed. Rep. of Germany . | |
| 592781 | 11/1977 | Switzerland | 33/144 |
| 1522744 | 8/1978 | United Kingdom . | |
| 1558843 | 1/1980 | United Kingdom . | |

*Primary Examiner*—Donald O. Woodiel
*Attorney, Agent, or Firm*—Kurt Kelman

[57] ABSTRACT

A measuring carriage for measuring the undulations and ripples of a worn rail head running surface is guided along the rail head by a pair of guide rollers laterally guiding the carriage along a portion of the gage side of the rail head which is not worn and a plurality of additional guide rollers selectively engageable with the running surface of the rail head for vertically guiding the measuring carriage along the running surface upon engagement therewith. The additional guide rollers include a pair of inner guide rollers, a pair of outer guide rollers and a pair of intermediate guide rollers spaced from each other in the operating direction. The pair of outer guide rollers defines a rigid measuring reference in the wave length of the longer undulations and they are spaced from each other a distance of 2 m. A respective lateral pair of the inner or intermediate guide rollers is selectively engaged with the running surface to define a rigid measuring reference in the shorter wave length of the ripples and these rollers are spaced from each other at least about 1/6th to ⅛th of the first-mentioned distance. A rail head running surface sensing element is vertically adjustably mounted on the measuring carriage substantially centered between the pairs of guide rollers.

13 Claims, 5 Drawing Figures

MEASURING APPARATUS FOR RAIL HEAD RUNNING SURFACE IRREGULARITIES

The present invention relates to a mobile apparatus arranged for measuring and indicating such irregularities as undulations and ripples on the running surface of a rail head, the apparatus being mounted on a railroad track for movement in an operating direction and the track including two rails having a rail head defining a gage side, a field side and a running surface. The apparatus comprises a frame of a track measuring car or a track working machine, a measuring carriage linked to the frame, drive means for vertically adjusting the measuring carriage in relation to the frame and for passing the carriage against the running surface of the rail head of a respective rail, guide roller means for vertically and laterally guiding the measuring carriage along the rail head, and a rail head running surface sensing element vertically adjustably mounted on the measuring carriage.

Measuring apparatus for indicating the surface condition of the rail head of a rail of a railroad track is known and has been used in conjunction with mobile apparatus for removing surface irregularities by means of rail grinding or planing tools. Such apparatus works according to a dynamic or a geometric method. This invention deals with apparatus for indicating the geometric position of rail head surface irregularities.

British Pat. No. 1,558,843, published Jan. 9, 1980, discloses apparatus mounted at the front and rear ends of a mobile rail grinding machine for sensing the surface condition of the rail heads before and after the grinding operation. Each apparatus has a set of feelers mounted side by side around the running surface and the gage side of the rail head, the feelers being supported by runners maintained in contact against the running surface and gage side of the rail head. The feelers emit measuring signals proportional to the displacement of each feeler and these signals are transmitted to a processing device comprising amplifiers and filters to provide output signals representing various amplitude values of undulatory deformations, which are recorded and may be displayed. While this arrangement is structurally relatively simple, the runners carrying the rail head surface feelers do not provide sufficient accuracy because, aside from the wear to which the supports are subjected, the contact between the feelers and the rail head surface is such that it is impossible to sense all the different sinuous undulations and ripples whose wave lengths differ greatly.

According to U.S. Pat. No. 4,135,332, dated Jan. 23, 1979, the rail head running surface measuring apparatus comprises a guide roller vertically guiding a carriage along the running surface of a rail head, the carriage having flanged wheels and four such guide rollers. Such a carriage is arranged in front of and behind a rail grinding mechanism for indicating surface irregularities by means of a gage associated with the guide rollers which sense the surface. The four guide rollers form a measuring reference providing a very accurate contact with the wave-like rail surface irregularities and correspondingly exact measuring values. However, the grinding operations themselves cause horizontal and vertical movements which impair the positioning of the measuring apparatus as it moves along the track and thus interferes with the accuracy of the measurements.

British Pat. No. 1,522,744, published Aug. 31, 1978, discloses a dynamic system for sensing rail surface deformations, which is based on the measurements by accelerometers connected to a surface feeling device. A voltage signal representative of the acceleration encountered by the feeling device moved along the rail surface is generated, amplified and filtered as a function of the speed of the feeling device along the rail, the filtered signal is integrated twice, then rectified and the rectified signal is amplitude-demodulated, spurious signals are eliminated by filtering the demodulated signal and the lastly filtered signal is recorded. Aside from the point-by-point sensing without any reference system, the signal processing in this dynamic system greatly limits the accuracy of the measurement indication.

German Pat. No. 825,427, published Dec. 17, 1951, discloses a track measuring car with two independent mechanisms for measuring the ordinate in a track curve and surface irregularities at rail joints, respectively. Each mechanism has its own carrier and sensing device connected by separate tackles to a recording device. In this manner, two separate measuring values are separately determined and indicated.

It is the primary object of the invention to provide a mobile apparatus of the first-described type which enables the rail head surface irregularities of railroad track rails to be sensed accurately, independent of the amplitude of the wave-like deformations of a worn running surface.

It is a more particular object of the present invention to sense such running surface deformations precisely within a wave length of about 30 cm to 2 m, which is the normal range of the length of ripples and undulations found in worn rails.

The above and other objects are accomplished in an unexpectedly simple manner according to this invention with guide roller means for vertically and laterally guiding the measuring carriage along the rail head, which includes a pair of guide rollers laterally guiding the measuring carriage along a portion of the gage side of the rail head which is not worn and the guide rollers being spaced from each other in the operating direction, and a plurality of additional guide rollers selectively engageable with the running surface of the rail head for vertically guiding the measuring carriage along the running surface of the rail head upon engagement within, the additional guide rollers each having an axis extending substantially parallel to the railroad track. The additional guide rollers include a pair of inner guide rollers, a pair of outer guide rollers and a pair of intermediately arranged guide rollers spaced from each other in the operating direction. The pair of outer guide rollers defines a rigid measuring reference in the wave length range of longer undulations and these rollers are spaced from each other a distance of about two meters. A respective pair of the inner or intermediate guide rollers selectively engaged with the running surface defines a rigid measuring reference in the shorter wave length of ripples and these guide rollers are spaced from each other a selected distance corresponding to at least about one sixth to one eighth of the distance between the outer guide rollers, preferably about 30 cm. The rail head running surface sensing element is substantially centered between the pairs of guide rollers.

This arrangement provides an absolutely dependable reference for the sensing element measurements since the measuring carriage exactly follows the rail head surface in lateral and vertical directions. Furthermore, since the guide rollers constitute the sole support of the measuring carriage on each rail, the guide means are worn much less during operation than measuring carriages with gliding guide elements, such as runners, guide rails and the like. This decreases maintenance requirements. The measuring apparatus of the invention delivers unexpectedly precise and readily reproducible measuring results which make it possible to reach a quality judgment of the surface condition of a measured section of track rail, in addition to delivering exact data concerning the geometric course of the rail surface deformations. More particularly, comparative measurements made before and after the running surface of the rail head has been contoured by suitable rail grinding, planing or other metal removing tools make it possible not only to evaluate the success of the contouring operation generally but also to determine the exact depth to which the metal has been removed. Such a measuring value comparison can be realized relatively simply with known electronic circuitry.

Since the apparatus of the present invention is of simple construction and requires relatively little space, existing track measuring cars or mobile track working machines may be readily equipped with this apparatus. As will be explained hereinafter, it is possible to match the spacing of the guide rollers of the measuring carriage with that of a tool carriage mounted on the same machine.

The guide rollers may be vertically adjustably mounted on the measuring carriage and such intermediately arranged guide rollers may be selectively engaged with, or disengaged from, the running surface of the rail head by vertical adjustment to obtain the selected distance between a respective lateral guide roller and either the intermediate guide roller or an outer guide roller, thus changing the measuring reference to a wave length of deformations encountered along the track rail. Alternatively, the intermediately arranged guide rollers are replaceably mounted on the measuring carriage adjacent the inner guide rollers for selecting the distance. For example, two guide rollers per measuring carriage of a diameter exceeding that of the other additional guide rollers may be stored on the apparatus and may be used to replace the additional guide rollers of smaller diameter at desired track sections to form the end points of the measuring reference.

The above and other objects, advantages and features of this invention will become more apparent from the following detailed description of certain now preferred embodiments thereof, taken in conjunction with the accompanying schematic drawing wherein FIG. 1 is a side elevational view of a track working machine incorporating the mobile apparatus of the invention;

Figure 1:
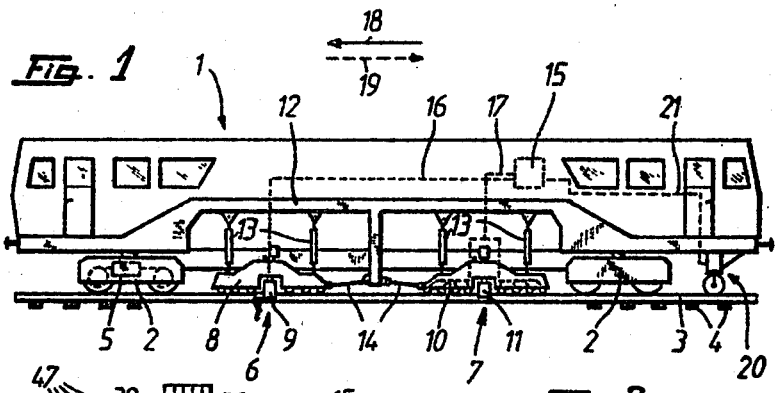

Referring now to the drawing and first to FIG. 1, there is shown track working machine 1 whose frame 12 is mounted by swivel trucks 2, 2 on a railroad track for movement in an operating direction indicated by arrows 18 and 19. The track includes two rails 3 fastened to ties 4 and each rail has a rail head defining gage side 26, a field side and a running surface. The machine is self-propelled and moved along the track by drive 5. In the illustrated embodiment, machine 1 is a rail contouring machine equipped with apparatus 6 which carries planing tool 9 for milling surface irregularities off the running surface of the rail head and mobile apparatus 7 arranged for measuring and indicating such running surface irregularities as undulations and ripples. Planing apparatus 6 and measuring apparatus 7 are of a similar structure, differing essentially by replacing planing tool 9 in the planing apparatus by sensing element 11 in the measuring apparatus. Apparatus 6 and 7 are arranged between swivel trucks 2, 2 and spaced from each other in the operating direction.

Planing apparatus 6, which forms no part of the present invention and may take any suitable form, is shown to comprise tool carriage 8 running on a guide roller arrangement along track rail 3 and carrying planing tool 9 which may be fixedly or adjustably mounted on carriage 8.

Illustrated measuring and indicating apparatus 7 comprises a respective measuring carriage 10 associated with each rail 3 and of substantially the same structure and dimensions as carriage 8. Each carriage 10 is vertically and laterally guided along the rail head of associated rail 3 without play by guide roller means to be described hereinafter. Rail head running surface sensing element 11 is vertically adjustably mounted on each measuring carriage for sensing such surface irregularities as undulations and ripples. The measuring carriages are in substantial alignment in a direction extending transversely to rails 3. Two transversely extending spacing members 28 (see FIG. 2) link the measuring carriages to each other, the ends of the spacing members being connected to the measuring carriages by universal joints. The spacing members are telescoping elements continuously adjustable in length to the gage of the track by hydraulic drives (not shown) to assure that measuring carriages 10 are always guided along the track rails without play, regardless of the gage of the track.

Carriages 8 and 10 are each linked to frame 12 by drive means constituted by two hydraulic jacks 13 for vertically adjusting each carriage in relation to the frame and for pressing the carriage against the running surface of the rail head of respective rail 3. The carriages associated with each rail are linked together by connecting rods 14 extending in the operating direction and they are connected by signal transmission lines 16 and 17 to signal indicating and recording apparatus 15 to be described hereinafter.

This arrangement assures the constant and tight guidance of the measuring carriage along a portion of the gage side of the rail head which is not worn and is normally not subject to grinding or planing to provide a dependable measuring reference for the measuring carriages associated with the railroad track rails so that the measuring results of several successive measuring passes can be immediately compared with each other, even if the respective passes were made with different selected distances between the vertical guide rollers.

Arrow 18 indicates the operating direction during a first pass when the rails are planed and the rail head surfaces are measured and the operating direction of a subsequent pass is indicated by arrow 19. The machine may be moved back and forth in a succession of operating passes until the surface measurements indicate the desired rail head contour.

Odometer 20 is arranged on machine frame 12 and emits a signal pulse per unit of length traversed by the machine, this single pulse being transmitted by line 21 to apparatus 15.

Figure 2:
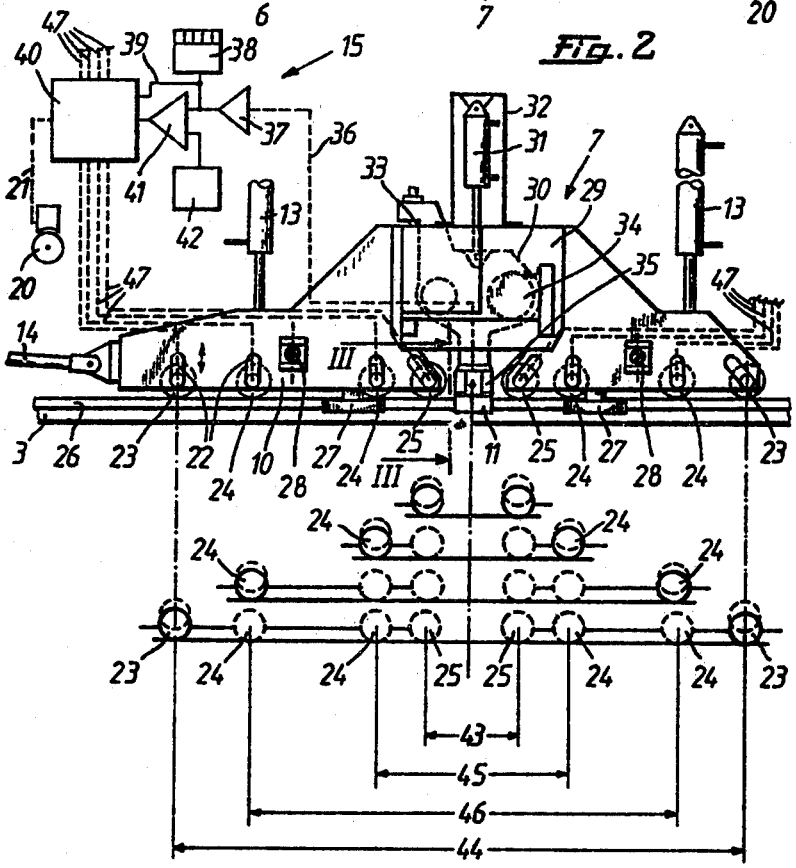
FIG. 2 is an enlarged side elevational view of the measuring apparatus of FIG. 1, view from the center of the track towards the track shoulder and also illustrating selected references as well as a circuit diagram of the circuit connecting the sensing element to indicating and recording devices.

FIG. 2 illustrates one embodiment of a measuring carriage according to the invention. In this embodiment, the guide roller means for vertically and laterally guiding measuring carriage 10 along the rail head comprises a pair of guide rollers 27 mounted on the carriage about rotatable vertical axles and laterally guiding the measuring carriage along a portion of gage side 26 (see FIG. 3) of the rail head which is not worn, guide rollers 27 being spaced in the operating direction, and a total of eight additional guide rollers 23, 24, 25 selectively engageable with the running surface of the rail head upon engagement therewith, the additional guide rollers each having an axle extending substantially parallel to the railroad track and being adjustably mounted in vertical slots 22. At least some of the additional guide rollers may be replaceably mounted in the vertical slots for removing such guide rollers and/or replacing them by guide rollers of different diameters.

As has been explained hereinabove, transversely extending spacing members 28 are linked to the gage side wall of measuring carriage 10 to hold guide rollers 27 without play against the rail head.

Measuring carriage 10 has a box-like center portion 29 wherein carrier 30 for sensing element 11 is arranged for vertical and lateral adjustment in relation to the measuring carriage, and means is provided for fixing the carrier in an adjusted position on the carriage. Drive means 31, 34 vertically adjusts the carrier in relation to carriage 10 in a vertical plane extending through the rail head or a plane parallel thereto, hydraulic drive 31 effecting the vertical adjustment and hydraulic drive 34 effecting the lateral adjustment of carrier 30 into the desired vertical plane. Hydraulic drive 31 is linked to carrier 30 and to bracket 32 of measuring carriage 10. The vertical adjustment of the carrier is delimited by adjustable stop 33 cooperating with an abutment of carriage center portion 29 and the lateral adjustment is similarly effected by transversely extending drive 34 shown in broken lines.

The additional guide rollers include a pair of inner guide rollers 25 and holder 35 for sensing element 11 is mounted on carrier 30 and projects downwardly substantially centered between the pairs of guide rollers.

The described arrangement enables the sensing element to be adjustably positioned in relation to any rail head profile, the adjustable stops making it possible to determine and fix selected positions and to return the sensing element to a predetermined adjustment position after intermediate adjustments have been made. If the guide rollers are replaceably mounted, worn rollers may be readily replaced and the effective measuring reference determined by the spacing of the additional guide rollers may be easily and simply changed.

The guide rollers, and more particularly additional guide rollers 23, 24, 25 are preferably anti-friction bearings with axles replaceably mounting the bearings. In view of the very small measuring tolerances, the considerably wear resistance and lack of maintenance requirements of anti-friction bearings, are particularly useful as guide rollers.

As shown in FIG. 2, the additional guide rollers include a pair of inner guide rollers 25, a pair of outer guide rollers 23 and two pairs of intermediately arranged guide rollers 24 spaced from each other in the operating direction. The pair of outer guide rollers 23 define a rigid measuring reference in the wave length range of longer undulations and these guide rollers are spaced from each other a distance 44 of about two meters. A respective pair of inner or intermediate guide rollers 25, 24 selectively engaged with the running surface, as indicated by full and broken lines in FIG. 2, defines a rigid measuring reference in the shorter wave length range of ripples and the guide rollers of the selected pair are spaced from each other a selected distance 43, 45, 46 corresponding to at least about one sixth to one eighth of distance 44 between outer guide rollers 23, distance 43 being about 30 cm.

The desired measuring reference for sensing element 11 is determined by the vertical adjustment of the selected pair of guide rollers 23, 24, 25 between which the sensing element is centered, the selected pair of guide rollers being fixed in vertical slots 22 when the guide rollers engage the running surface of the rail head. The distance between the axles of the guide rollers in the operating direction determines the length of the reference, the effective rollers being schematically shown at the bottom of FIG. 2 in full lines while the guide rollers which have been removed or have been vertically adjusted to be out of engagement with the rail head are shown in broken lines. The smallest distance 43 between the two inner guide rollers corresponds to about half the width of a crib of a standard railroad track, i.e. about 30 cm. The maximum distance 44 between the two outer guide rollers corresponds to about the length of a tie 4, i.e. about two meters. The selected use of intermediate guide rollers 24 enables the measuring reference to be adjusted to distances 45 or 46 to correspond to other wave lengths of wave-like deformations encountered in worn running surfaces of rail heads. Depending on the measuring procedure selected, it is also possible to engage any or all of the additional guide rollers with the running surface to provide a measuring reference connecting the high points of the running surface deformation.

Sensing element 11 is arranged to emit a measuring signal corresponding to sensed running surface irregularities and the illustrated apparatus further comprises signal indicating and recording device 15 and a circuit connecting device 15 to the sensing element for transmitting the signal to the device for visibly indicating the measuring signal thereon and, in the illustrated embodiment, for recording it. The circuit comprises signal transmission line 36 which, depending on whether holder 35 carries a single sensing element or an array of sensing elements, consists of a single wire or a cable holding a number of wires each connected to a respective sensing element. The sensing element or elements may be any type of sensor capable of emitting an electrical or electronic signal corresponding to sensed geometrical configurations. The emitted and transmitted signal is amplified in amplifier 37 and the amplified signal is transmitted to indicating device 38 which may be mounted on an operator's cab in machine 1. Transmission line 39 further transmits the amplified signal to a recording and memory device 40. The amplified signal is further transmitted from amplifier 37 to one input of comparator circuit 41 whose other input is connected to information carrier 42 in whose memory are stored comparative measuring data, such as data from a preceding measuring pass. These data may be fed to the other input of the comparator circuit. The output of circuit 41 is also connected to recording and memory device 40. Odometer 20 emits signal pulses corresponding to the distance traveled by machine 1 and transmission line 21 transmits these signal pulses to device 40 so that the measuring data recorded and stored therein are correlated with respective locations of the track by suitable markers appearing on the graphs showing the rail head deformations. Each additional guide roller is connected to the recording and memory device 40 by transmission line 47 to coordinate the selected measuring reference with the measuring data recorded and stored in device 40. To close the circuit, switch contacts may be associated with each additional guide roller to correspond to the lower and upper end positions of the rollers.

With this arrangement, the operator may at all times remote control or monitor the measuring procedure since the measuring data are not only recorded and stored but also visually indicated so that, in case of extraordinary measurements indications, such as highly deformed running surface sections, such sections may be noted and marked for a possible further operating pass to make certain that the running surface is in suitable condition.

Figure 3:
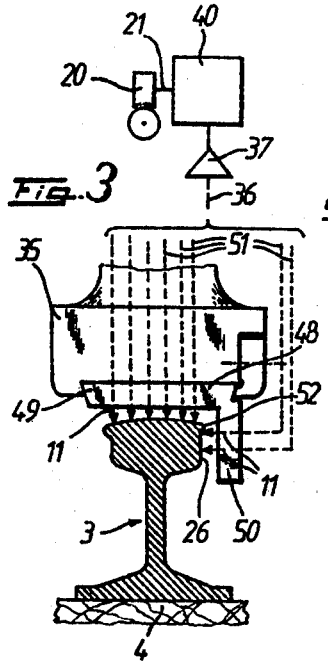
FIG. 3 is an enlarged, partial section of the measuring apparatus along line III—III of FIG. 2.

FIG. 3 shows holder or measuring head 35 on an enlarged scale. Ledge 48 is wedged to the underside of measuring head 35 and this L-shaped ledge is comprised of a horizontally extending arm 49 facing the running surface of the rail head and a vertically extending arm 50 facing gage side 26 of the rail head. An array of sensing elements 11 (shown by arrows) is carried by L-shaped ledge 48 to sense the entire running surface on a portion of the gage side of the rail head which has not been worn. Transmission wires 51 are connected to each sensing element to constitute transmission line 36 hereinabove described. The position of ledge 48 and the sensing elements carried thereby with respect to the rail head is determined by the vertical and lateral adjustment of carrier 30 in relation to measuring carriage 10 by hydraulic drives 31 and 34. The constant and accurate maintenance of this position in relation to rail 3 during the movement in the operating direction is assured by the guidance without play of the measuring carriage along the rail, hydraulic drives 13 subjecting additional guide rollers 23, 24, 25 to vertical loads pressing the engaged additional guide rollers against the running surface and continuously spread apart telescoping spacing members 28 pressing guide rollers 27 against the gage sides of the rail heads at portions thereof which are not worn. Since guide rollers 27 run along the middle or lower portion of the gage side of the rail head, any overflow metal 52 on the rail head has no influence on the accurate lateral positioning of the measuring carriage in relation to rail 3 during operation.

Figure 5:
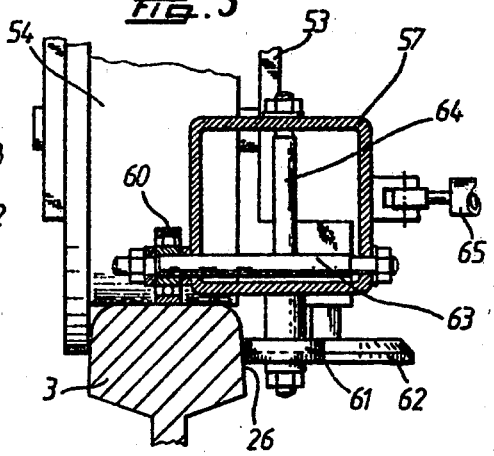
FIG. 5 is a section similar to that of FIG. 3, along line V—V of FIG. 4.
Figure 4:
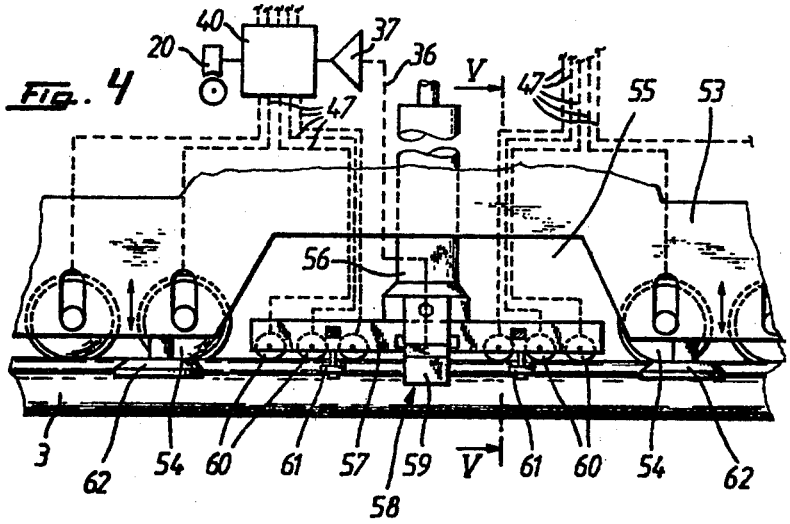
FIG. 4 is a view similar to that of FIG. 2, showing another embodiment of the measuring apparatus.

FIGS. 4 and 5 illustrate another embodiment of the measuring carriage according to this invention, measuring carriage 53 being shown only fragmentarily to illustrate its center portion. The center portion of the measuring carriage between inner guide rollers 54 is recessed to form recess 55 and carrier 56 has a lower end projecting into the recess, the carrier being vertically and laterally adjustable in a manner analogous to that described in connection with carrier 30 of the first-described embodiment. Elongated holder 57 extending in the operating direction and carrying measuring head 58 with sensing element or elements 59 is affixed to carrier 56. Three pairs of vertical guide rollers 60 and a pair of lateral guide rollers 61 are mounted on holder 57 for guiding the sensing element holder along the running surface of the rail head. These guide rollers are also preferably anti-friction bearings and at least vertical guide rollers 60 preferably have axles replaceably mounting the bearings on the sensing element holder. Lateral guide rollers 61 for holder 57 as well as lateral guide rollers 62 for the measuring carriage engage portions of the gage side of the rail head which are not worn, as in the first-described embodiment.

As described hereinabove, all vertical guide rollers 54, 60 are connected by transmission lines 47 to signal indicating and memory device 40 and sensing element 59 is connected by transmission line 36 to amplifier 37 and device 40, thus producing the measuring data indication and storage hereinabove described.

This embodiment is of particular advantage when running surface deformation of very small wave lengths are to be measured, such as ripples in the centimeter range. Accurate measurements in this range require a measuring reference which is shorter than the axle distance between inner guide rollers 54.

FIG. 5 shows guide rollers 60 and 61 constituted by anti-friction bearings and like bearings may be used for the measuring carriage guide rollers. Holder 57 is shown as a hollow member of rectangular cross section and axles 63 and 64 of the guide rollers are detachably mounted on the holder so that the guide rollers may be rapidly and selectively utilized for producing a measuring reference of the desired length for sensing element holder 57, depending on the spacing between the selected pair of guide rollers 60. This figure also shows the linked connection of a spacing member 65 connecting measuring carriage 53 to a like measuring carriage transversely aligned therewith for measuring the other rail. The spacing member is shown as a hydraulic jack which continuously presses guide rollers 61 against the gage sides of the rail heads, regardless of the track gage.

As shown in FIG. 1, tool carriage 8 of planing apparatus 8 is substantially of the same structure and dimensions as measuring carriage 10 of measuring apparatus 7. Sensing element 11 may be removably mounted for selective replacement of the sensing element by rail planing tool 9 whereby the apparatus may be converted to a rail contouring machine. Thus, machine 1 may be used selectively for contouring the rail head and for measuring the contoured rail head, with the particular advantage of guiding and supporting conditions for the sensing element and the planing tool. Since surfacing and measuring of the rail head are thus effected under the same geometrical conditions and the same guidance and support forces, the measurement indications of a single measuring pass may precisely indicate the required planing depth and, after planing, the record will accurately establish the actual planing depth and the depth of any remaining undulations or ripples. Furthermore, since the same machine can be used for contouring and measuring, the acquisition costs are cut almost in half compared to buying two machines for each purpose and the operation is much simplified.

While the present invention has been described and illustrated in connection with presently preferred embodiments, many variations and modifications will occur to those skilled in the art without departing from the spirit and scope thereof, as defined in the appended claims. More particularly, the number, structure and positioning of the guide rollers may be varied widely and the mobile measuring apparatus may be utilized in various manners. Thus, it may be used as auxiliary equipment on existing track measuring or maintenance machines, including track rail grinding machines, as well as on a self-propelled vehicle.

What is claimed is:

1. A mobile apparatus mounted on a railroad track for movement in an operating direction, the track including two rails each having a rail head defining a gage side, a field side and a running surface, the apparatus being arranged for measuring and indicating such running surface irregularities as undulations and ripples, which comprises (a) a frame, (b) a measuring carriage linked to the frame, (c) drive means for vertically adjusting the measuring carriage in relation to the frame and for pressing the carriage against the running surface of the rail head of a respective rail, (d) guide roller means for vertically and laterally guiding the measuring carriage along said rail head, the guide roller means including (1) a pair of guide rollers laterally guiding the measuring carriage along a portion of the gage side of said rail head which is not worn and the guide rollers being spaced from each other in the operating direction, and (2) a plurality of additional guide rollers selectively engageable with the running surface of said rail head for vertically guiding the measuring carriage along the running surface of said rail head upon engagement therewith, the additional guide rollers each having an axis extending substantially parallel and transversely to the railroad track, the additional guide rollers including a pair of inner guide rollers, a pair of outer guide rollers and a pair of intermediately arranged guide rollers spaced from each other in the operating direction, the pair of outer guide rollers defining a rigid measuring reference in the wave length range of longer undulations and being spaced from each other a distance of about two meters, and a respective one of the pairs of the inner or intermediate guide rollers selectively engaged with the running surface defining a rigid measuring reference in the shorter wave length range of ripples and being spaced from each other a selected distance corresponding to at least about one sixth to one eighth of the distance between the outer guide rollers, and (e) a rail head running surface sensing element vertically adjustably mounted on the measuring carriage substantially centered between the pairs of guide rollers.

2. The mobile apparatus of claim 1, wherein the selected distance is about 30 cm.

3. The mobile apparatus of claim 1, wherein the intermediately arranged guide rollers are replaceably mounted on the measuring carriage adjacent the inner guide rollers for selecting the distance.

4. The mobile apparatus of claim 1 or 3, wherein the guide roller means vertically and laterally guides the measuring carriage along said rail head without play, further comprising a carrier for the sensing element and drive means for vertically adjusting the carrier in relation to the carriage in a vertical plane extending through the rail head or a plane parallel thereto.

5. The mobile apparatus of claim 4, further comprising a holder for the sensing element mounted on the carrier.

6. The mobile apparatus of claim 5, further comprising guide rollers mounted on the holder for vertically guiding the sensing element holder along the running surface of said rail head.

7. The mobile apparatus of claim 6, wherein the additional guide rollers are anti-friction bearings and further comprising axles replaceably mounting the bearings on the sensing element holder.

8. The mobile apparatus of claim 1 or 3, wherein the additional guide rollers are anti-friction bearings and further comprising axles replaceably mounting the bearings on the measuring carriage.

9. The mobile apparatus of claim 8, wherein the pair of guide rollers laterally guiding the measuring carriage are anti-friction bearings and further comprising axles replaceably mounting the bearings on the measuring carriage.

10. The mobile apparatus of claim 1 or 3, wherein a respective one of the measuring carriages is associated with each rail, the carriages being in substantial alignment in a direction extending transversely to the rails, and further comprising transversely extending spacing members continuously adjustable to the gage of the track and linking the measuring carriages to each other.

11. The mobile apparatus of claim 1 or 3, wherein the sensing element is arranged to emit a measuring signal corresponding to sensed running surface irregularities and further comprising a signal indicating device and a circuit connecting the signal indicating device to the sensing element for transmitting the signal to the device for visibly indicating the measuring signal thereon.

12. The mobile apparatus of claim 11, further comprising a device for storing the measuring signal connected to the circuit.

13. The mobile apparatus of claim 1 or 3, wherein the sensing element is removably mounted on the carriage for selective replacement of the sensing element by a rail planing tool whereby the apparatus may be converted to a rail contouring machine.

* * * * *